US009014605B2

(12) United States Patent
Maruyama

(10) Patent No.: US 9,014,605 B2
(45) Date of Patent: Apr. 21, 2015

(54) IMAGE FORMING APPARATUS

(75) Inventor: Yasuhiro Maruyama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 293 days.

(21) Appl. No.: 13/362,268

(22) Filed: Jan. 31, 2012

(65) Prior Publication Data

US 2012/0219334 A1 Aug. 30, 2012

(30) Foreign Application Priority Data

Feb. 25, 2011 (JP) ..... 2011-039494

(51) Int. Cl.
*G03G 15/16* (2006.01)

(52) U.S. Cl.
CPC ..... *G03G 15/161* (2013.01); *G03G 15/1685* (2013.01)

(58) Field of Classification Search
CPC ..... G03G 15/163; G03G 15/167; G03G 15/1665; G03G 15/1685; G03G 15/161
USPC ..... 399/121, 310, 313, 314
See application file for complete search history.

(56) References Cited

U.S. PATENT DOCUMENTS

| | | | | |
|---|---|---|---|---|
| 7,440,720 | B2 * | 10/2008 | Takehara | 399/299 |
| 2004/0126129 | A1 | 7/2004 | Kobayashi | |
| 2005/0265756 | A1 * | 12/2005 | Swift | 399/313 |
| 2006/0170936 | A1 | 8/2006 | Takehara | |

FOREIGN PATENT DOCUMENTS

| | | |
|---|---|---|
| JP | 2000-112259 | 4/2000 |
| JP | 2004133419 A | 4/2004 |
| JP | 2004264523 A | 9/2004 |
| JP | 2005-107554 | 4/2005 |
| JP | 2005-189563 | 7/2005 |

OTHER PUBLICATIONS

Notification of Reasons for Refusal for Japanese patent application No. 2011-039494 mailed Jan. 29, 2013.

* cited by examiner

*Primary Examiner* — David Gray
*Assistant Examiner* — Jessica L Eley
(74) *Attorney, Agent, or Firm* — Banner & Witcoff, Ltd.

(57) ABSTRACT

An image forming apparatus includes: a developer-image carrier; a conveyance belt that contacts the developer-image carrier and conveys a developer image; and a transfer member contacting the conveyance belt from an opposite side of the developer-image carrier to transfer the developer image onto the conveyance belt. The transfer member includes a main roller body and a movable member including a first end portion fixed to a circumferential surface of the main roller body and a second end portion extending outward in a radial direction of the main oiler body and movable with respect to the first end portion. A rotation axis line of the main roller body is provided downstream of the rotation axis line of the developer-image carrier in a movement direction of the conveyance belt such that the main roller body contacts the developer-image carrier while interposing the conveyance belt therebetween.

13 Claims, 13 Drawing Sheets

IMAGE FORMING APPARATUS

CROSS-REFERENCE TO RELATED APPLICATIONS

This application claims priority from Japanese Patent Application No. 2011-039494 filed on Feb. 25, 2011, the entire subject matter of which is incorporated herein by reference.

TECHNICAL FIELD

The present invention relates to an image forming apparatus.

BACKGROUND

There have been proposed an image forming apparatus, in which transfer rollers are provided to face photosensitive drums, and a transfer belt is interposed between the transfer rollers and the photosensitive drums. In such an image forming apparatus, a rotation center of each of transfer rollers is provided to deviate from a corresponding photosensitive drum toward the downstream side of the corresponding photosensitive drum in a movement direction of an intermediate transfer belt. For example, as shown in FIG. 10, a rotation axis line Z of a transfer roller 100 is provided to deviate from a rotation axis line X of a photosensitive drum 101 toward the downstream side of the rotation axis line X in the movement direction of the intermediate transfer belt 102, and to be pushed up.

If the transfer roller 100 is provided as described above, in each transfer unit where a toner image is transferred onto the intermediate transfer belt 102, as shown in FIG. 10, on the intermediate transfer belt 102, an upstream nip H, a physical nip I, and a downstream nip J are formed.

The physical nip is an area on the intermediate transfer belt 102 where the intermediate transfer belt 102 is put between the photosensitive drum 101 and the transfer roller 100. A toner image formed on the photosensitive drum is transferred onto the intermediate transfer belt 102 at the physical nip I.

The upstream nip H is located upstream of the physical nip I in the movement direction of the intermediate transfer belt 102. The upstream nip H is an area on the intermediate transfer belt 102, where only the photosensitive drum 11 comes into contact with the intermediate transfer belt 102. Before coming into contact with the transfer roller 100, the intermediate transfer belt 102 conies into with the photosensitive drum 101 at the upstream nip H.

The downstream nip J is located downstream of the physical nip I in the movement direction of the intermediate transfer belt 102. The downstream nip J is an area on the intermediate transfer belt 102 where only the transfer roller 100 and the intermediate transfer belt 102 come into contact with each other. At the downstream nip J, even if the intermediate transfer belt 102 is separated from the photosensitive drum 101, the intermediate transfer belt 102 comes into contact with the transfer roller 100.

If the upstream nip the physical nip I, and the downstream nip J are secured as described above, good toner-image transfer becomes possible. Specifically, the following reasons may be considered. Before a toner image on the photosensitive drum 101 reaches the physical nip I, at the upstream nip H, the toner image is nipped by the photosensitive drum 101 and the intermediate transfer belt 102. Therefore, the toner image on the photosensitive drum 101 may fly from the photosensitive drum 101 before reaching the physical nip I, such that a smaller amount of toner is transferred onto the intermediate transfer belt 102 (pre-transfer occurs).

Further, since the physical nip I is provided, an electric field sufficient for transfer is formed between the photosensitive drum 101 and the transfer roller 100. Therefore, at the physical nip I, the toner image on the photosensitive drum 101 is transferred onto the intermediate transfer belt 102.

Further, at the downstream nip electrical charge having moved to the intermediate transfer belt 102 at the upstream nip H or the like returns o the transfer roller 100. Therefore, it is possible to reduce peeling discharge when the photosensitive drum 101 and the intermediate transfer belt 102 are separated from each other.

SUMMARY

Illustrative aspects of the present invention provide an image forming apparatus which enables reducing a size of an apparatus body thereof by reducing a size of a transfer roller while maintaining image quality.

DETAILED DESCRIPTION

<General Overview>

Recently, in accordance with a demand for a reduction in the sizes of image forming apparatuses, it has been desired to reduce the diameter of the transfer roller 100. However, in the above-described related-art image forming apparatus, in order to secure a sufficient amount of downstream nip J while securing the physical nip I necessary for transfer, the transfer roller 100 needs to have a predetermined diameter or more. Therefore, it is difficult to reduce the diameter of the transfer roller 100.

Figure 10:
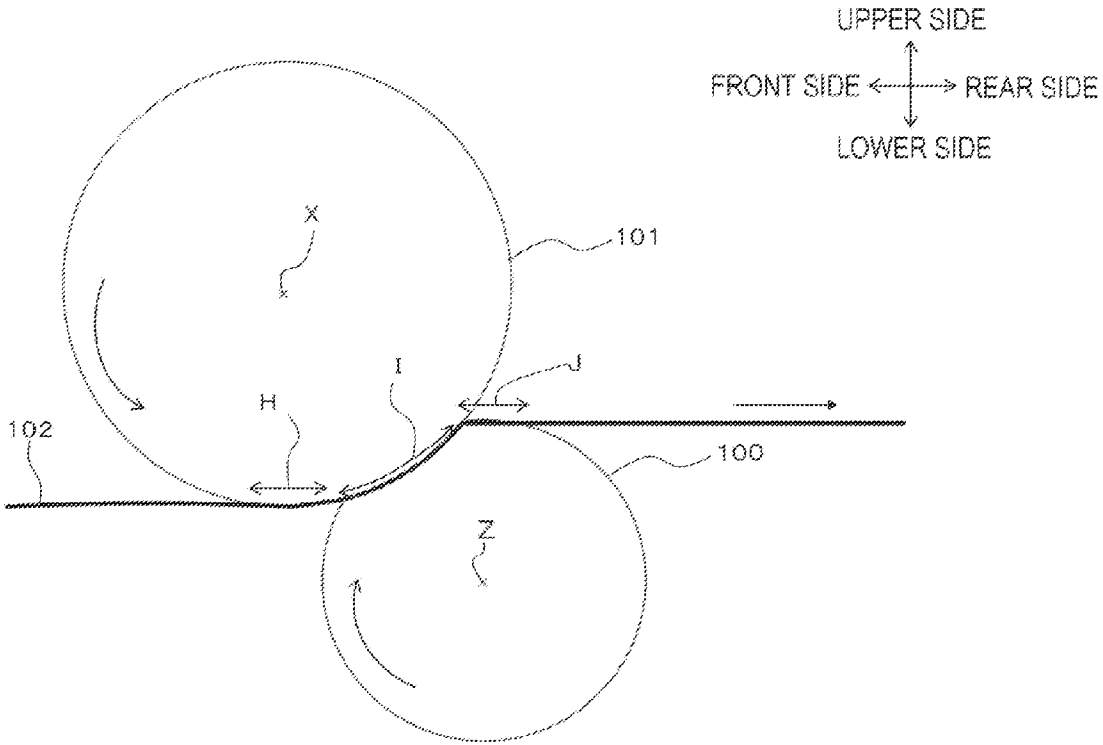
FIG. 10 is a sectional side view of a photosensitive drum, an intermediate transfer belt, and a transfer roller according to a related art.
Figure 11:
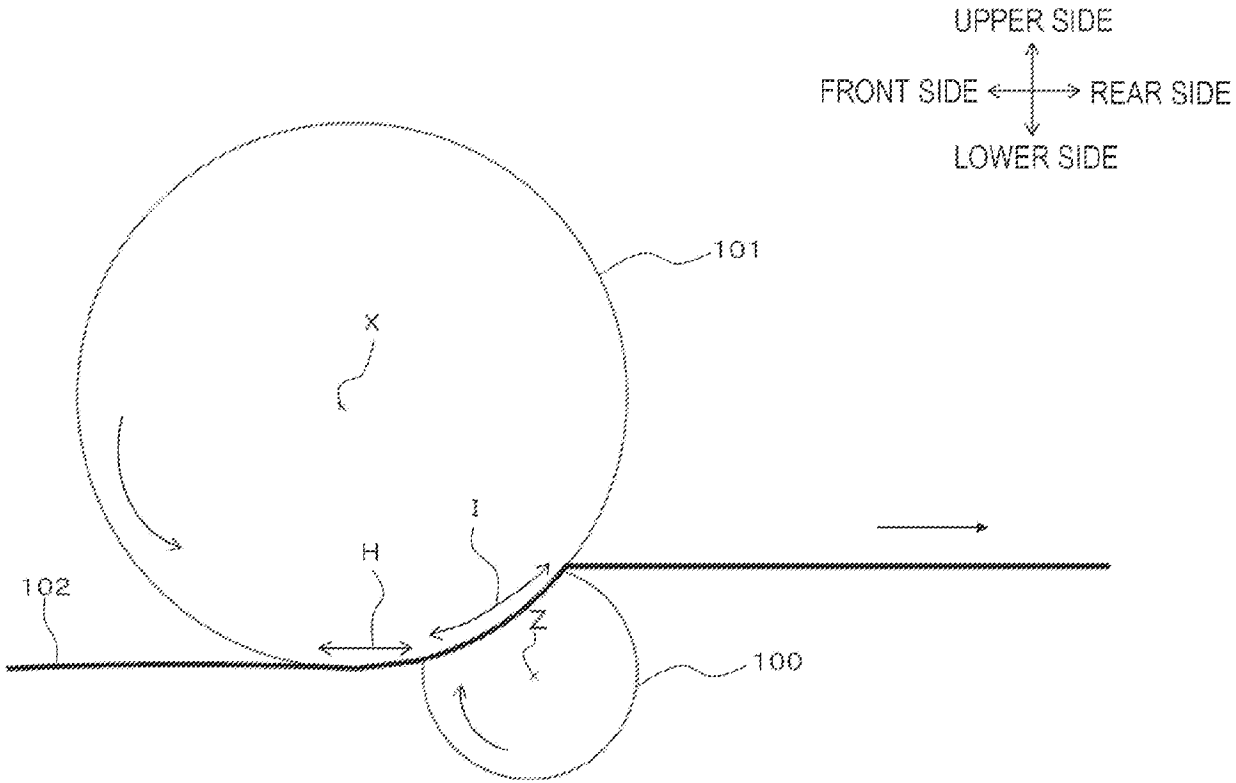
FIG. 11 is a view explaining a task which is caused in a case of reducing the transfer roller according to the related art.
Figure 12:
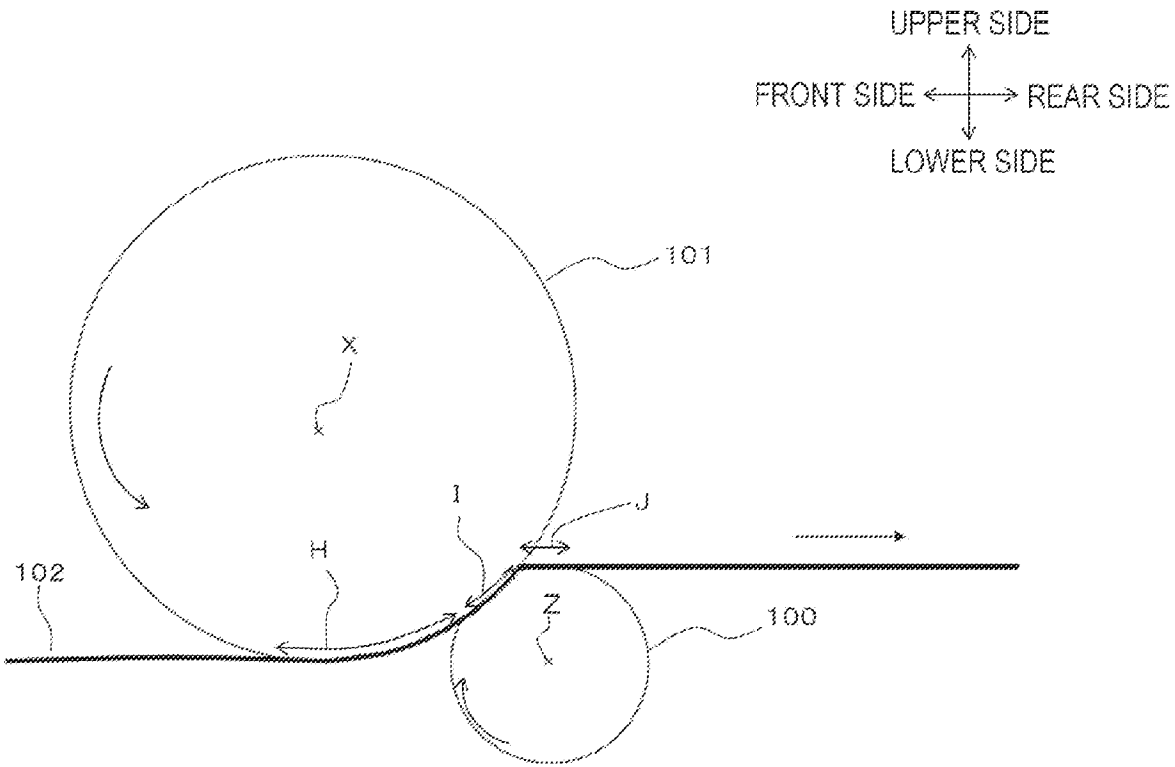
FIG. 12 is a view explaining another task which is caused in a case of reducing the transfer roller according to the related art.

If the transfer roller 100 is provided, for example, as shown in FIG. 11 for making it possible to sufficiently secure the physical nip I while reducing the transfer roller 100, the downstream nip is not sufficiently secured, as compared to the state of FIG. 10. Also, if the transfer roller 100 is provided as shown in FIG. 12, for making it possible to sufficiently secure the physical nip J while reducing the transfer roller 100, the physical nip I is not sufficiently secured, as compared to the state of FIG. 10.

Therefore, illustrative aspects of the present invention provide an image forming apparatus which enables reducing a size of an apparatus body thereof by reducing a size of a transfer roller while maintaining image quality.

According to a first illustrative aspect of the invention, there is provided an image forming apparatus comprising: a developer-image carrier, which is configured to carry a developer image on a surface thereof, and which is rotatable; a conveyance belt, which is provided to be in contact with the developer-image carrier, and which is movable in a direction perpendicular to a rotation axis line of the developer-image carrier, wherein the conveyance belt is configured to convey the developer image carried on the developer-image carrier, and wherein the developer-image carrier is provided on a first side of the conveyance belt; and a transfer member, which is provided on a second side of the conveyance belt that is opposite to the first side, and which is configured to contact the conveyance belt to transfer the developer image carried on the developer-image carrier onto the conveyance belt, wherein the transfer member comprises: a main roller body, which is configured to rotate in the same direction as a movement direction of the conveyance belt at a contact position with the conveyance belt, and which is provided to be parallel with the rotation axis line of the developer-image carrier; and a movable member comprising: a first end portion fixed to a circumferential surface of the main roller body; and a second end portion, which extends outward in a radial direction of the main roller body from the first end portion, and which is movable with respect to the first end portion, and wherein rotation axis line of the main roller body is provided downstream of the rotation axis lure of the developer-image carrier in the movement direction of the conveyance belt such that the main roller body contacts the developer-image carrier while interposing the conveyance belt therebetween.

According to a second illustrative aspect of the invention, there is provided an image forming apparatus comprising: a roller member; a developer-image carrier belt, which is suspended on a circumferential surface of the roller member, and which is movable in a direction perpendicular to a rotation axis line of the roller member, wherein the developer-image carrier belt is configured to carry a developer image on a surface thereof; a conveyance belt, which is provided to be in contact with developer-image carrier belt at a position where the roller member is provided, and which is movable in a direction perpendicular to the rotation axis line of the roller member, wherein the conveyance belt is configured to convey the developer images carried on the developer-image carrier belt, wherein the developer-carrier belt is provided on a first side of the conveyance belt; and a transfer member, which is provided on a second side of the conveyance belt that is opposite to the first side, and which is configured to contact the conveyance belt to transfer the developer image carried on the developer-image carrier belt onto the conveyance belt, wherein the transfer member comprises: a main roller body, which is configured to rotate in the same direction as a movement direction of the conveyance belt at a contact position with the conveyance belt, and which is provided to be parallel with the rotation axis line of the roller member; and a movable member comprising: a first end portion fixed to a circumferential surface of the main roller body; and a second end portion, which extends outward in a radial direction of the main roller body from the first end portion, and which is movable with respect to the first end portion, and wherein rotation axis roller member in the movement direction of the conveyance belt such that the main roller body contacts the developer-image carrier belt while interposing the conveyance belt therebetween.

According to first illustrative aspsect, the transfer member includes the first end portion fixed to the circumferential surface of the main roller body, and the second end portion that extends outward in a radial direction of the main roller body and is movable with respect to the first end portion. According to the rotation of the roller member, the movable member passes the contact position of the main roller body and the conveyance belt, and comes into contact with the surface of the conveyance belt on the transfer member side, on the downstream side of the contact position in the movement direction of the conveyance belt. Therefore, even if the diameter of the main roller body is small, it is possible to reduce peeling discharge when the developer-image cagier and the conveyance belt are separated from each other, and good image formation is possible.

According to the second illustrative aspect, the transfer member includes the first end portion fixed to the circumferential surface of the main oiler body, and the second end portion that extends outward in a radial direction of the main roller body and is movable with respect to the first end portion. According to the rotation of the roller member, the movable member passes the contact position of the main roller body and the conveyance belt, and comes into contact with the surface of the conveyance belt on the transfer member side, on the downstream side of the contact position the movement direction of the conveyance belt. Therefore, even if the diameter of the main roller body is small, it is possible to reduce peeling discharge when the developer-image carrier belt and the conveyance belt are separated from each other, and good image formation is possible.

<Exemplary Embodiments>

Exemplary embodiments of the present invention will now be described with reference to the drawings.

(Entire Configuration of Image Forming Apparatus)

Figure 1:
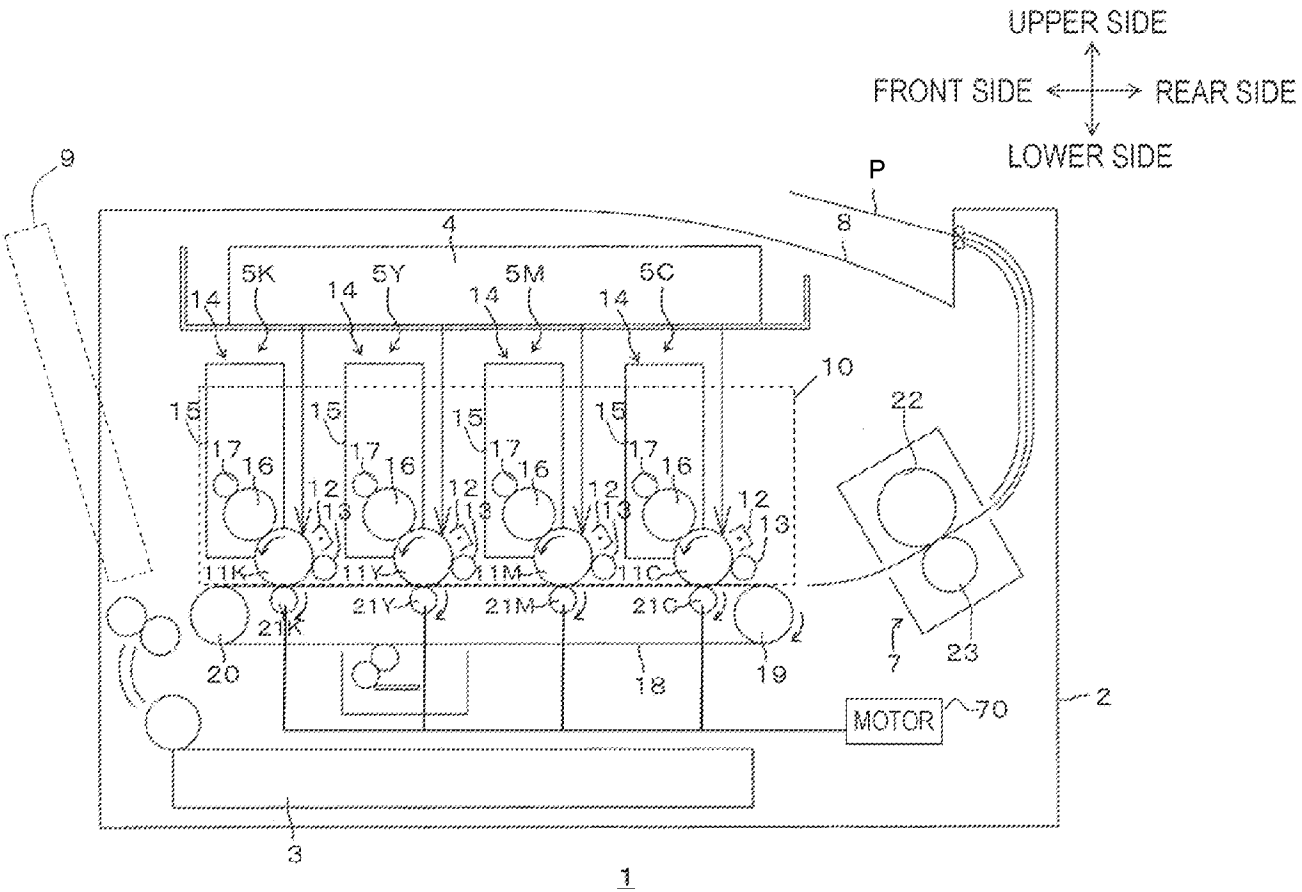
FIG. 1 is a schematic sectional side view of an image forming apparatus.

Referring to FIG. 1, an image forming apparatus 1 includes a sheet feeding cassette 3, a scanner unit 4, process units 5 (5K, 5Y, 5M, and 5C), a transfer unit 6, and a fixing unit 7 provided in a main body casing 2. The main body casing 2 includes a sheet discharge tray 8 provided at an upper portion thereof. The main body casing 2 includes a front cover 9 provided at one side wall of the main body casing 2 to be openable and closable. The plurality of process units 5 is provided to a drawer member 10, and can be drawn from the main body casing 2 when the front cover 9 is open. Incidentally, a tandem color printer is one example of the image forming apparatus 1.

In the following description, the side on which the front cover 9 is provided (the right side of FIG. 1) is defined as the front side, and its opposite side (the left side of FIG. 1) is defined as the rear side. The left and right sides of the image forming apparatus 1 are defined as the left and right sides when the image forming apparatus 1 is seen from the front side.

The sheet feeding cassette 3 is provided at the bottom portion of the main body casing 2. Each of sheets P accommodated in the sheet feeding cassette 3 is transferred toward the transfer unit 6 and the process units 5 by various rollers.

The scanner unit 4 is provided at the upper side of the main body casing 2. Although not shown, the scanner unit 4 includes a laser-beam emission unit, a polygon mirror, a plurality of lenses, and reflective mirrors. In the scanner unit 4, laser beams, which correspond to cyan, magenta, yellow, and black, respectively, are respectively irradiated onto photosensitive drums 11 (one example of a developer-image carrier) of the process units 5.

The process units 5 are provided in parallel along a conveyance direction of each sheet P a front-rear direction) between the scanner unit 4 and the transfer unit 6. Each of the process units 5 includes a photosensitive drum 11, a scorotron charger 12, a cleaning roller 13, and a developing unit 14.

The photosensitive drums 11 (11K, 11Y, 11M, and 11C) are provided to be rotatable on rotation axis lines extending in a left-right direction. The photosensitive drums 11 rotate in directions shown by arrows in FIG. 1 (that is, clockwise). The scorotron chargers 12 are provided along the rotation axis lines of the photosensitive drums 11, with predetermined gaps from the photosensitive drums 11 such that the scorotron chargers 12 do not come into contact with the photosensitive drums 11.

Each cleaning roller 13 for cleaning a surface of corresponding photosensitive drum 11 is provided upstream of a corresponding scorotron charger 12 in the rotation direction of the corresponding photosensitive drum 11, to be adjacent to the corresponding scorotron charger 12.

The drawer member 10 has a pair of side plates provided to face each other in a left-right direction. The of side plates supports the photosensitive drums 11, the scorotron chargers 12, and the cleaning units 13 by pinching those components from both sides in the left-right direction. For purpose of convenience, in FIG. 1, only the left side plate is shown.

Each developing unit 14 includes a developer container 15 for accommodating toner (one example of developer), the developing roller 16, and a feeding roller 17. The developer container 15 has a box shape. The developing roller 16 is held at the lower end portion of the developer container 15, with its circumferential surface partially exposed to the outside. The feeding roller 17 is in contact with the upper portion of the developing roller 16.

In each process unit 50 configured as described above, the surface of the photosensitive drum 11 is uniformly and positively charged by the scorotron charger 12, and then is exposed by high-speed scan with a laser beam from the scanner unit 4. Therefore, the potential of the exposed portion is lowered so that an electrostatic latent image based on image data is formed.

The toner in the developer container 15 is fed to the electrostatic latent image on the photosensitive drum 11 by the feeding roller 17 and the developing roller 16. Therefore, the toner is selectively carried on the surface of the photosensitive drum 11 so that the electrostatic latent image is visualized. Consequently, a toner image is formed by reversal development.

The transfer unit 6 includes a sheet conveyance belt 18 (one example of a conveyance belt), a drive roller 19, a driven roller 20, and transfer rollers 21 (21K, 21Y, 21M, and 21C) (one example of a transfer member). The sheet conveyance belt 18 is provided to stretch between the pair of the drive roller 19 and the driven roller 20, and face the four photosensitive drums 11 from the side lower than the photosensitive drums 11.

The drive roller 19 and the driven roller 20 are provided in parallel to be separate from each other in the front-rear direction. The sheet conveyance belt 18 is composed of an endless belt and is suspended between the drive roller 19 and the drive roller 19. The sheet conveyance belt 18 rotates in a direction show by an arrow in FIG. 1 (that is, counterclockwise). The upper portion of the sheet conveyance belt 18 moves from the front side toward the rear side.

At the positions on the opposite sides of the sheet conveyance belt 18 to the photosensitive drums 11, the transfer rollers 21 are provided. According to the movement of the sheet conveyance belt 18, a sheet P conveyed on the sheet conveyance belt 18 passes through the gaps between the sheet conveyance belt 18 and the photosensitive drums 11, sequentially. Then, when each of toner images on the surfaces of the photosensitive drums 11 faces the sheet P, the corresponding toner image is transferred onto the sheet P by a transfer bias applied to a corresponding transfer roller 21.

The transfer rollers 21 are connected with a motor 70 provided inside the main body casing 2, and receive the driving force of the motor 70 so as to rotate at the same rotation speed as that of the photosensitive drums 11. The transfer rollers 21 rotate in directions shown by arrows in FIG. 1 (that is, counterclockwise).

The fixing unit 7 includes a heating roller 22 and a pressing roller 23. In the fixing unit 7, the sheet P is sent while being held between the heating roller 22 and the pressing roller 23, such that the toner image on the sheet P is fixed by heat.

The sheet P is discharged from the fixing unit 7 and is loaded on the sheet discharge tray 8.

(Configuration of Transfer Unit)

Next, a specific configuration of a photosensitive drum 11, the sheet conveyance belt 18, and a transfer roller 21 according to the exemplary embodiment will be described with reference to appropriate drawings. The following detailed description of the photosensitive drums 11, the sheet conveyance belt 18, and the transfer rollers 21 will be made focusing on the photosensitive drum 11C and the transfer roller 21C. However, the other photosensitive drums 11 and transfer rollers 21 have also the same configuration.

Figure 2:
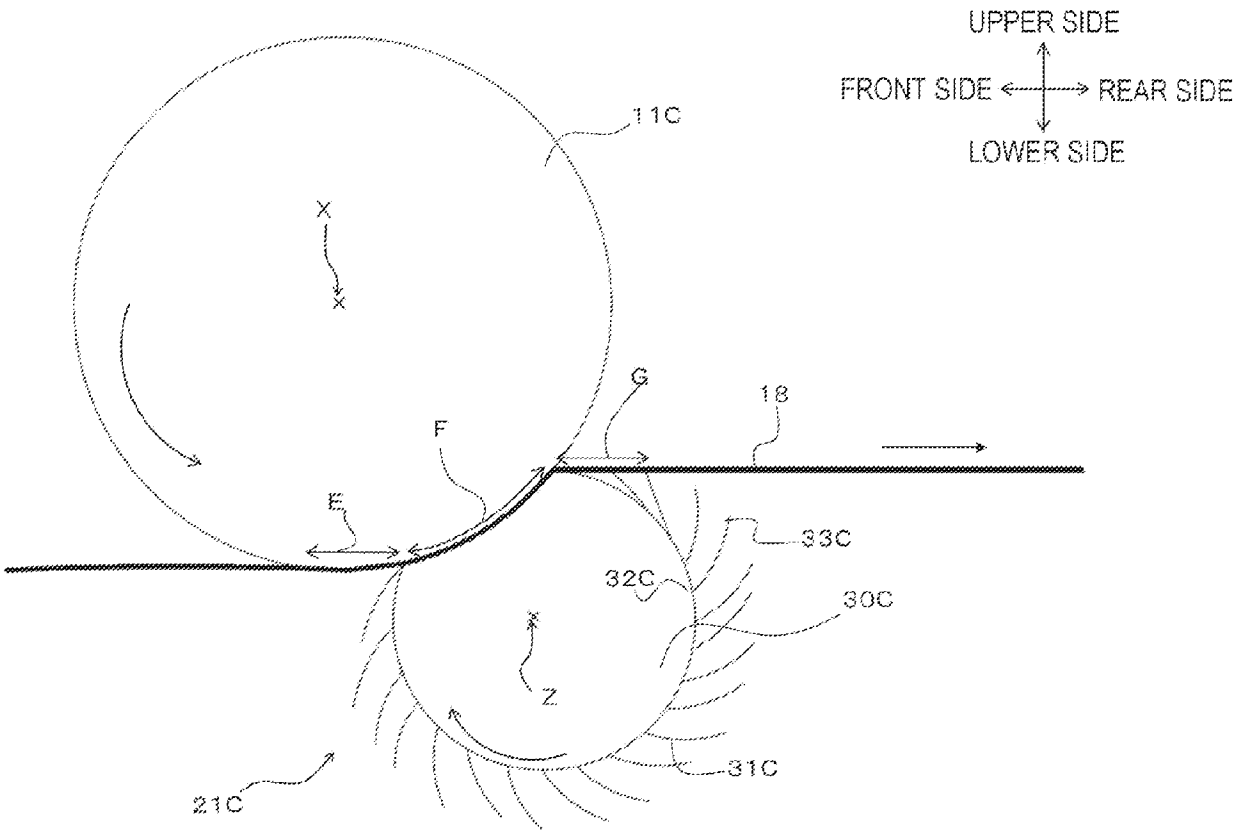
FIG. 2 is a sectional side view of a photosensitive drum, a conveyance belt, and a transfer roller.

As shown in FIG. 2, the photosensitive drum 11C rotates on a rotation axis line X extending in the left-right direction, the direction shown by an arrow in FIG. 2. The photosensitive drum 11C is provided to come into contact with the sheet conveyance belt 18 from the side upper than the sheet conveyance belt 18.

As shown in FIG. 2, the transfer roller 21C includes a main roller body 30C, and a plurality of hairs 31C (one example of a movable member) transplanted into a surface of the main roller body 30C. The plurality of hairs 31C having the same length is transplanted into the surface of the main roller body 30C by electrostatic flocking. The main roller body 30C is made of a conductive rubber material. The main roller body 30C rotates on a rotation axis line Z extending in the left-right direction, in a direction shown by an arrow in FIG. 2. The rotation axis line Z is parallel with the rotation axis line X. The width of the main roller body 30C in the left-right direction is substantially the same as the width of the photosensitive drum 11C in the left-right direction. The rotation axis line Z of the transfer roller 21C is provided to deviate from the rotation axis line X of the photosensitive drum 11C toward the downstream in the movement direction of the sheet conveyance belt 18.

Each of the hairs 31C has a bonded portion 32C (one example of a first end portion), and a movable portion 33C (one example of a second end portion). The bonded portion 32C is bonded to the surface of the main roller body 30C by an adhesive or the like. The movable portion 33C is an end portion of the correspond hair 31 which is directed to the outer side in the radial direction of the main roller body 30C with respect to the bonded portion 32C. The movable portion 33C is movable with respect to the bonded portion 32C.

The hairs 31C are transplanted into the main roller body 30C in advance, to lie down toward the upstream in the rotation direction of the main roller body 30C. The hairs 31C are bonded to the main roller body 30C in advance such that the movable portions 33C inclines toward the upstream side of the bonded portions 32C in the rotation direction of the main roller body 30C. The hairs 31C may be made of nylon or polyester containing a conducting agent (for example, carbon black), or other materials.

According to the photosensitive drum 11C, the sheet conveyance belt 18, and the transfer roller 21C configured as described above, a first nip portion E, a second nip portion F, and a third nip portion G are formed on the sheet conveyance belt 18.

As shown FIG. 2, the first nip portion E is an area on the sheet conveyance belt 18 which is located upstream of the transfer roller 21C in the movement direction of the sheet conveyance belt 18, and where the photosensitive drum 11C and the sheet conveyance belt 18 come into contact with each other. Before a toner image formed on the photosensitive drum 11C is transferred onto a sheet P by the transfer roller 21C, at the first nip portion E, the toner image on the photosensitive drum 11C is nipped by the sheet conveyance belt 18 and the photosensitive drum 11C. Therefore, it is possible to reduce a phenomenon (which is called pre-transfer) in which, before a toner image on the photosensitive drum 11C is nipped by the transfer roller 21C and the photosensitive drum 11C, the toner image flies toward the sheet conveyance belt 18.

The second nip portion F is an area on the sheet conveyance belt 18 where the sheet conveyance belt 18 is nipped by the photosensitive drum 11C and the transfer roller 21C. The second nip portion F makes it possible to give a sufficient electric field to a toner image entering between the photosensitive drum 11C and the transfer roller 21C. Therefore, good transfer is possible.

The third nip portion G is an area on the sheet conveyance belt 18 which is located upstream of the second nip portion F in the movement direction of the sheet conveyance belt 18, and where the sheet conveyance belt 18 comes into contact with the hairs 31C but does not come into contact with the main roller body 30C. Specifically, the third nip portion G is formed such that the hairs 31C having passed through the second nip portion F according to the rotation of the transfer roller 21C come into contact with a surface of the sheet conveyance belt 18 facing the transfer roller 21C. As the transfer roller 21C further rotates, the hairs 31C are separated from the sheet conveyance belt 18.

When the sheet conveyance belt 18 passes through the first nip portion E, electric charge is injected into the sheet conveyance belt 18. The electric charge can return to the main roller body 30C through the hairs 31C at the third nip portion G Therefore, it is possible to reduce discharge (which is called peeling discharge) when each photosensitive drum 11 and the sheet conveyance belt 18 are separated from each other.

After the hairs 31C are separated from the sheet conveyance belt 18, the hairs 31C lie toward the upstream side in the rotation direction of the transfer roller 21C. Therefore, according to the rotation of the transfer roller 21C, the hairs 31C enter the second nip portion F, without coming into contact with the opposite surface of the sheet conveyance belt 18 to the first nip portion E. In other words, at the first nip portion E, the hairs 31C do not come into contact with the sheet conveyance belt 18.

Figure 3B:
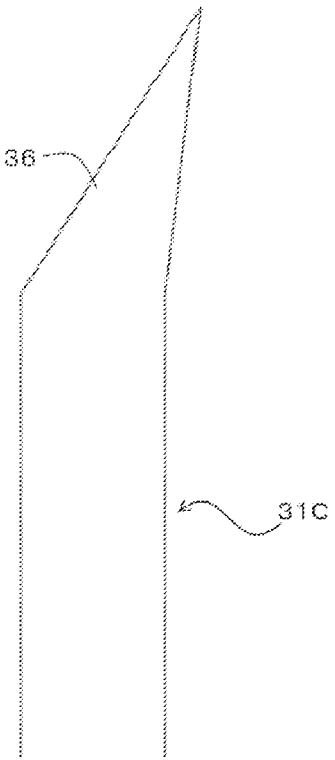
FIGS. 3A and 3B are enlarged views of distal end portions of hairs.
Figure 3A:
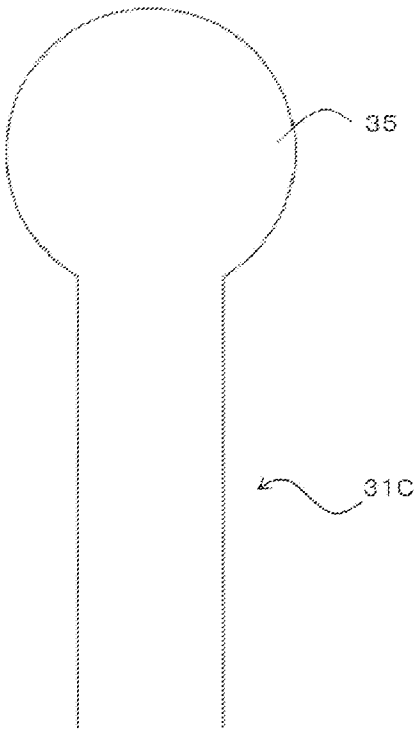

As shown in FIGS. 3A and 3B, it is preferable to provide a spherical portion 35 or an inclined surface portion 36 directed to the rotation direction of a corresponding transfer roller 21, to the distal end portion of each hair 31C. According thereto, it is possible to increase a contact area of each hair 31 with the sheet conveyance belt 18, and to move a larger amount of electrical charge from the sheet conveyance belt 18 to the main roller body 30C.

In the above-described exemplary embodiment, it is possible to achieve the following effects.

By using the transfer rollers 21 shown in the exemplary embodiment, it is possible to reduce the size of the image forming apparatus 1. A specific example thereof will be described with reference to FIGS. 4A and 4B.

Figure 4B:
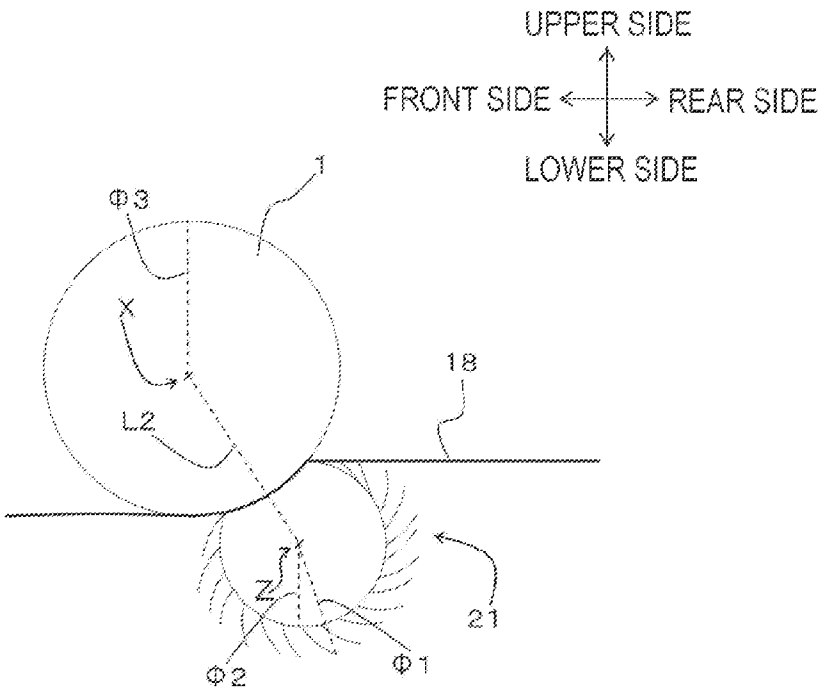
FIGS. 4A and 4B are views explaining effects of the exemplary embodiment.
Figure 4A:
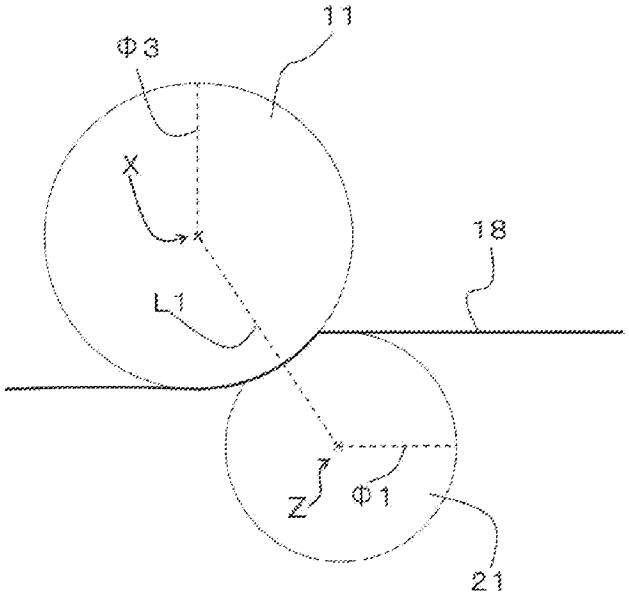

For example, as shown in FIG. 4A, a radius of the transfer roller 100 is denoted by $\phi 1$. Further, as shown in FIG. 4B, a length from the rotation center of the transfer roller 21 to a distal end of a hair 31 is denoted by $\phi 1$, a radius of the main roller body 30 is denoted by $\phi 2$, and a radius of the photosensitive drum 11 is denoted by $\phi 3$. In this case, as shown in FIG. 4A, a length L1 of a straight line connecting the rotation axis line X of the photosensitive drum 11 and the rotation axis line Z of the transfer roller 100 is the sum of $\phi 1$ and $\phi 3$ (i.e., $L1=\phi 1 1+\phi 3$).

Meanwhile, each transfer roller 21 includes hairs 31. At each second nip portion F, the hairs 31 are nipped between the sheet conveyance belt 18 and a corresponding main roller body 30 so as to fall down along the circumferential surface of the corresponding main roller body 30. Therefore, the length L2 of the straight line connecting the rotation axis line X and the rotation axis line Z becomes the sum of $\phi 2$ and $\phi 3$. Here, the difference (L1−L2) between the lengths L1 and L2 becomes ($\phi 1-\phi 2$) (i.e., $L1-L2=\phi 1-\phi 2$), and thus it is possible to narrow the gap between the transfer roller 21 and the photosensitive drum 11 by the difference. Therefore, it is possible to reduce the size of the image forming apparatus 1 by using the transfer rollers 21 shown in the exemplary embodiment. Here, the lengths L1 and L2 do not reflect the thickness of the sheet conveyance belt 18.

Each third nip portion G is formed on the sheet conveyance belt 18 by the contact between the hairs 31 and the sheet conveyance belt 18. Therefore, occurrence of peeling discharge is reduced, and thus good transfer is possible.

The movable portions 33 of the hairs 31 lie down to be inclined toward the upstream sides of the bonded portions 32 in the rotation direction of the transfer rollers 21. According thereto, at the second nip portions F, the hairs 31 do not disturb the rotation of the transfer rollers 21. Therefore, it is possible to perform good toner-image transfer.

Each transfer roller 21 includes the hairs 31 provided on the circumferential surface of a corresponding main roller body 30. Therefore, it is possible to densely provide the hairs 31 to the circumferential surfaces of the main roller bodies 30. As a result, it is possible to increase the contact area of the hairs 31 with the third nip portion G, and thus to further reduce the peeling discharge.

By positively rotating the transfer rollers 21 by using the motor, it is possible to prevent the hairs 31 from being continuously nipped between the main roller bodies 30 and the sheet conveyance belt 18, so that it is possible to prevent the hairs 31 from being deformed.

<Modification to Exemplary Embodiments>

(First Modification)

A first modification will be described with reference to FIGS. 5A and 5B. In the following description of the modification, members identical to those described in the above-described exemplary embodiment will be denoted by the same reference symbols, and the redundant description will not be repeated.

Figure 5A:
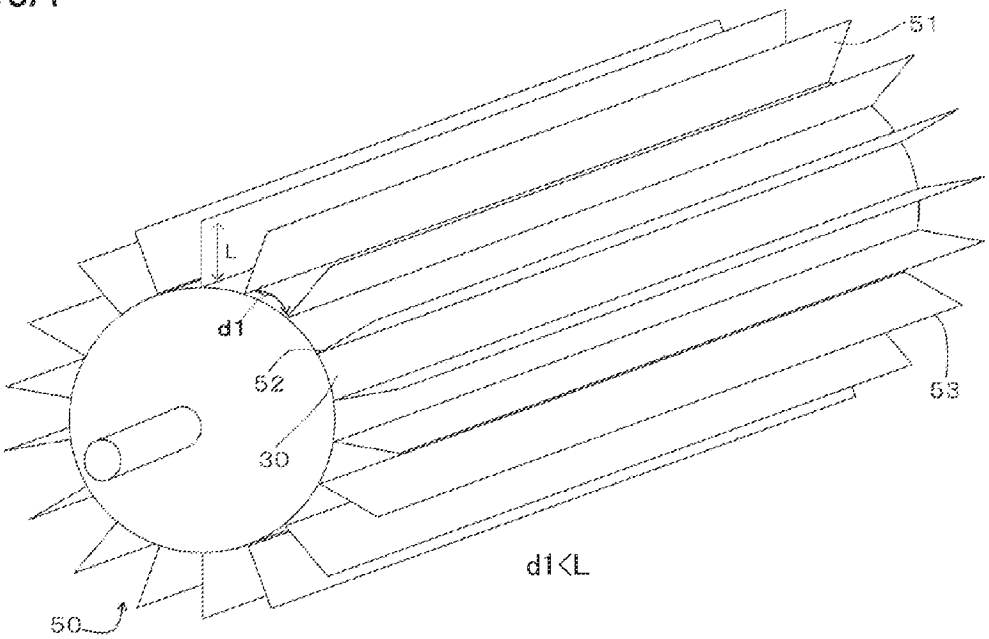
FIG. 5A is a perspective view of a transfer roller according to a first modification in a case of (L>d1)
Figure 5B:
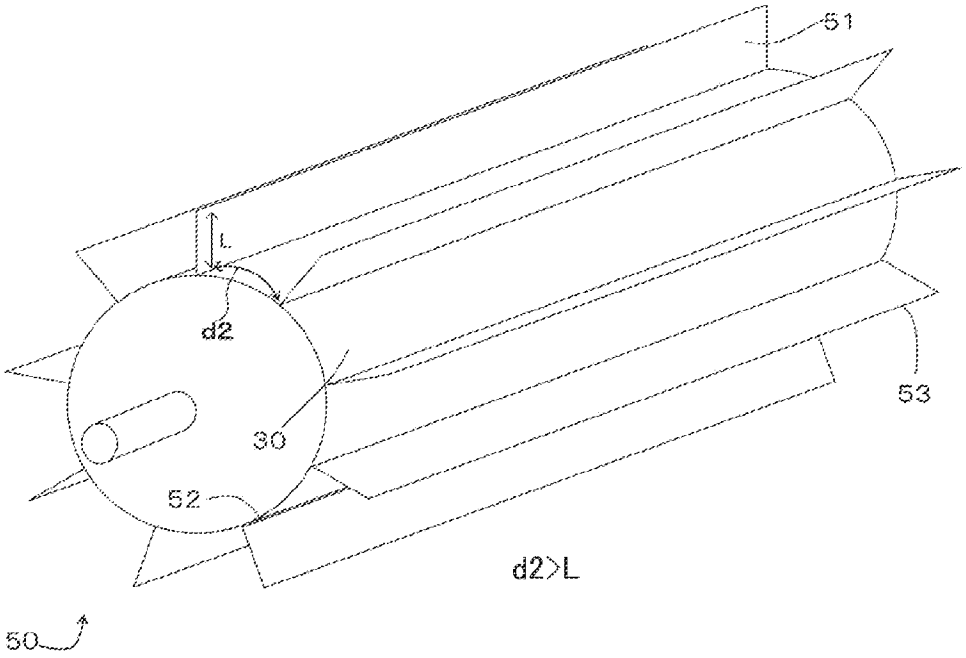
FIG. 5B is another perspective view of the transfer roller according to the first modification in a case of (L≤d1)

As shown in FIGS. 5A and 5B, the transfer roller 50 includes a main roller body 30, and elastically deformable films 51 (one example of a movable member). The films 51 are made of nylon or polyester containing a conducting agent (for example, carbon black), or other materials.

As shown in FIGS. 5A and 5B, each of the films 51 includes a bonded portion 52 (one example of a first end portion), and a movable portion 53 (one example of a second end portion). The bonded portion 52 is bonded to the surface of the main roller body 30 by an adhesive or the like. The movable portion 53 is an end portion of the corresponding film 31 which is directed to the outer side in the radial direction of the main roller body 30 from the bonded portion 52. The movable portion 53 is movable with respect to the bonded portion 52.

At each second nip portion F, the films 51 are nipped between the sheet conveyance belt 18 and the main roller body 30 so as to fall down along the circumferential surface of the main roller body 30. According to the rotation of the transfer roller 50, the main roller body 30 passes through the second nip portion F and then is separated from the sheet conveyance belt 18. However, even after the films 51 pass through the second nip portion F, their distal end portions come into contact with the sheet conveyance belt 18 so that a third nip portion G can be formed.

The length of each of the films 51 shown in FIG. 5A from a bonded portion 52 to a movable portion 53 is L, and each film 51 is bonded to the circumferential surface of the main roller body 30 such that the length L becomes an interval d1 between the corresponding film 51 and an adjacent film 51. In FIG. 5A, the length L of each film is larger than the interval d1. According thereto, it is possible to densely provide the films 51 to the main roller body 30, and to widely provide the area of the third nip portion G on the sheet conveyance belt 18.

By using the films 51 as described above, it is possible to further improve the durability of the transfer roller 21.

The length of each of the films 51 shown in FIG. 5B from a bonded portion 52 to a movable portion 53 is L, and each film 51 is provided to the circumferential surface of the main roller body 30 such that the length L becomes an interval d2 between the corresponding film 51 and an adjacent film 51. In FIG. 5B, the length L of each film is smaller than the interval d2. In this case, when each film 51 is fallen along the main roller body 30C at the second nip portion F, the corresponding film 51 does not overlap an adjacent film 51. Thus, even if a filth 51 is fallen at the second nip portion F, the corresponding film 51 does not overlap an adjacent film 51, so as not to form a step between those adjacent films. Therefore, it is possible to reduce disturbance in a transferred image.

(Second Modification)

Now, a second modification will be described with reference to FIG. 6.

Figure 6:
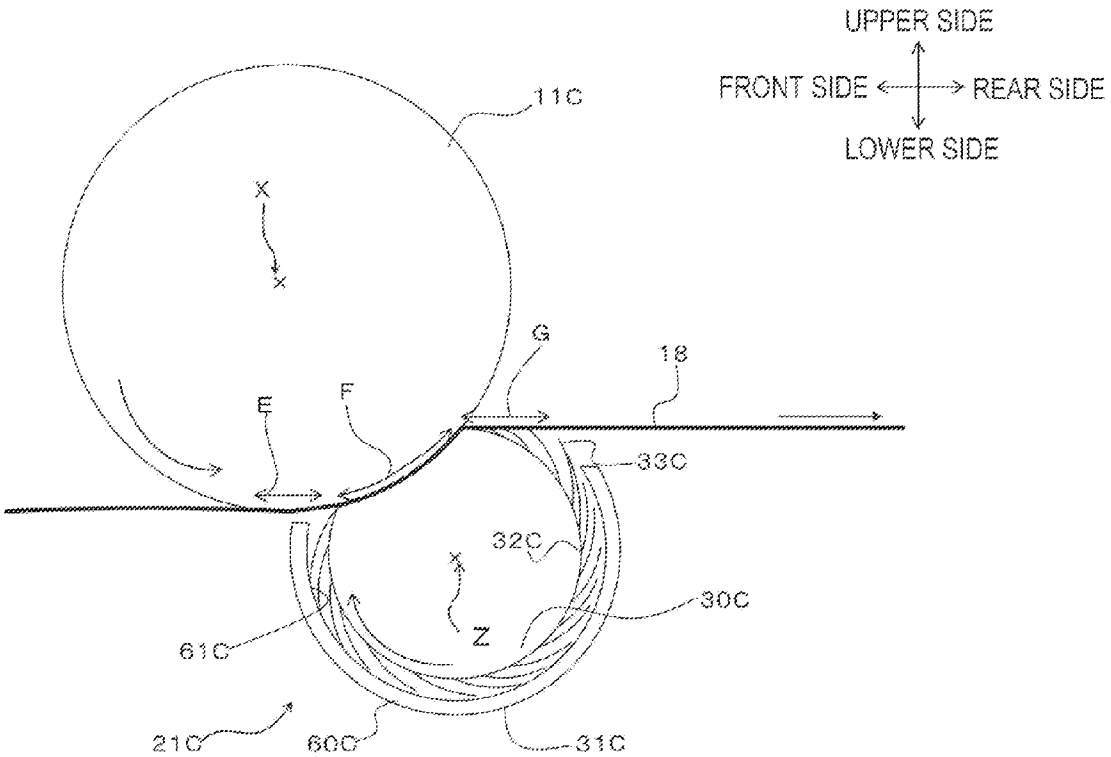
FIG. 6 is a sectional side view of a photosensitive drum, a transfer roller, and a conveyance belt according to a second modification.

As shown in FIG. 6, a transfer unit 6 according to the second modification includes a guide wall 60C for guiding hairs 31C toward the circumferential surface of a main roller body 30C. The guide wall 60C is a plate-shaped member having an arc shape as seen from the left-right direction. The guide wall 60C extends along a circumferential surface of a transfer roller 21 in the left-right direction. A guide wall 60 having the same configuration as that of the guide wall 60C are also provided to each of the transfer rollers 21K, 21M, and 21Y.

The guide wall 60C is provided below a sheet conveyance belt 18 so as to cover the circumferential surface of the transfer roller 21C. The guide wall 60C has an inner circumferential surface 61C facing a corresponding photosensitive drum 11. The guide wall 60C is provided with a gap from the main roller body 30C such that, when the hairs 31C enter between the main roller body 30C and the inner circumferential surface 61C in accordance with the rotation of the transfer roller 21C, the hairs 31C fall down toward the main roller body 30C.

By providing the guide walls 60 for guiding the hairs 31 toward the main roller bodies 30 to the transfer units as described above, it s possible to prevent the hairs 31 from coming into contact with other members in the main body of the image forming apparatus 1 so as not to disturb the rotation of the main roller bodies 30 in addition to reduce the size of the main body of the image forming apparatus 1.

(Other Modifications)

In the above-described exemplary embodiments, the sheet conveyance belt 18 is used as an example of a conveyance belt. Alternatively, an intermediate transfer belt may be used.

Figure 7:
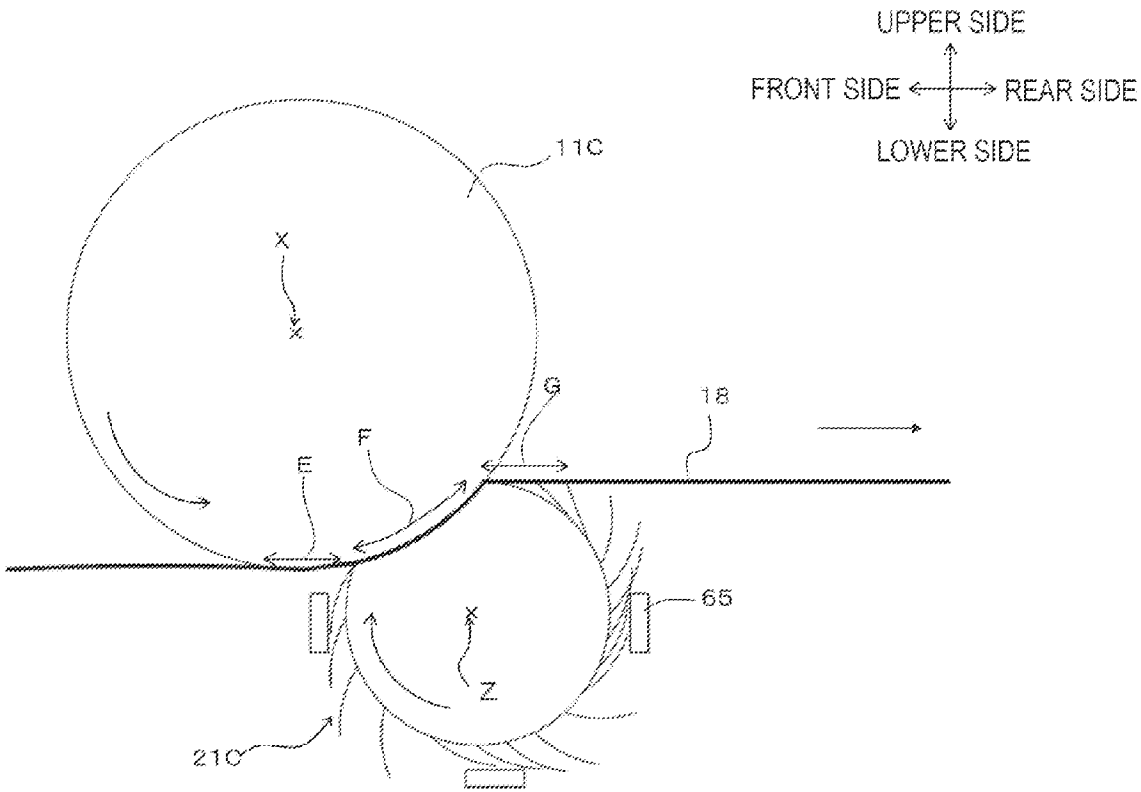
FIG. 7 is a view illustrating another exemplary embodiment regarding a guide wall.

Also, in the above-described exemplary embodiments, the circumferential surfaces of the transfer rollers 21 are covered with the guide walls 60. However, instead of the guide walls 60, guide plates 65 may be provided with gaps from the transfer rollers 21 along the rotation directions of the transfer rollers 21, as shown in FIG. 7. The guide plates 65 are provided along the transfer rollers 21 in the left-right direction.

Further, in the above-described exemplary embodiments, the plurality of hairs 31 or films 51 has a constant length. However, the plurality of hairs 31 or films 51 may not have a constant length.

In the above-described exemplary embodiments, the sheet conveyance belt 18 is used as the example of the conveyance belt. Alternatively, an intermediate transfer belt may be used.

Moreover, in the above-described exemplary embodiments, the photosensitive drums 11 are used as members for carrying toner images. However, instead of the photosensitive drums 11, a photosensitive belt 80 may be used as an example of a developer-image carrier belt. This example is shown in FIGS. 8 and 9.

Figure 8:
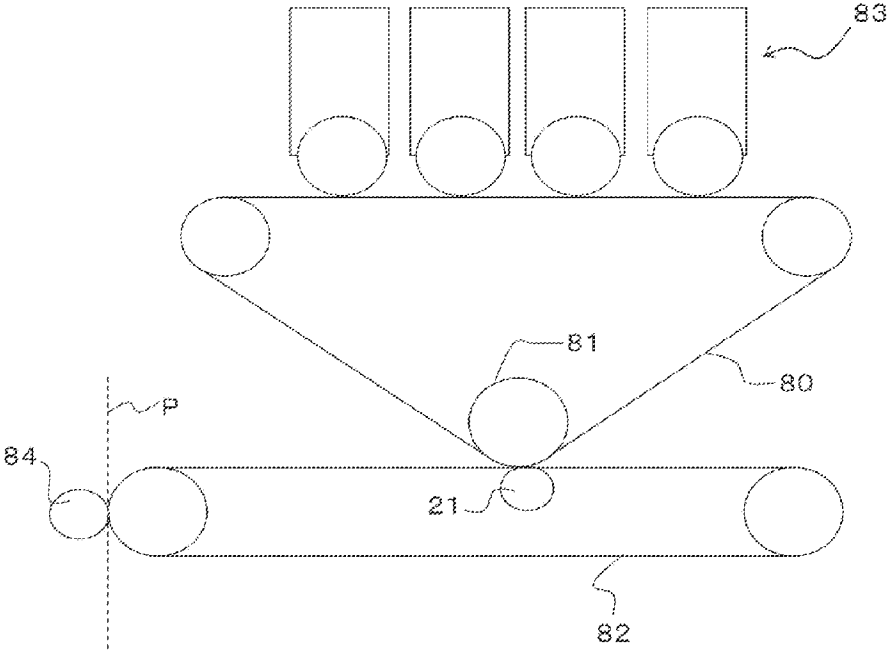
FIG. 8 is a view illustrating an example of an image forming apparatus using a developer-image carrier belt.

As shown FIG. 8, a surface of the photosensitive belt 80 is exposed by an exposing unit (not shown), such that an electrostatic latent image is formed thereon, and the electrostatic latent image is developed into a toner in age by developing units 83. The toner image passes between a transfer roller 21 and a roller member 81 on the intermediate transfer belt 82 provided below the developing units 83, such that the toner image is transferred onto the intermediate transfer belt 82. The toner image transferred on the intermediate transfer belt 82 is transferred onto a sheet P passing between a secondary transfer roller 84 and the intermediate transfer belt 82.

Figure 9:
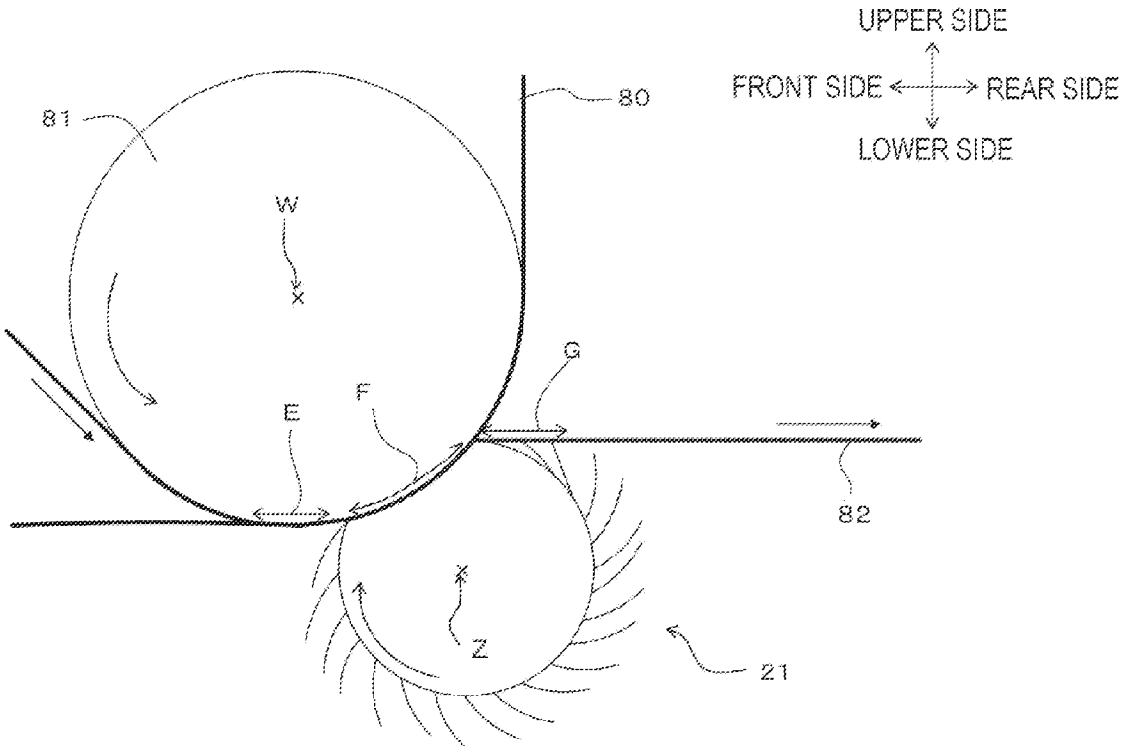
FIG. 9 is a view of an example of the developer-image carrier belt.

As shown in FIG. 9, the photosensitive belt 80 is suspended on the roller member 81 extending in parallel with the rotation axis line Z of the transfer roller 21, so as to be wound on the circumferential surface of the roller member 81. The photosensitive belt 80 extends along the circumferential surface of the roller member 81 above the intermediate transfer belt 82. The surface of photosensitive belt 80 is exposed to a laser beam from a scanner unit 4, so that an electrostatic latent image is formed on the surface of the photosensitive belt 80.

When the developer is fed to the formed electrostatic latent image, the electrostatic latent image is developed into a toner image. When the roller member 81 rotates in a direction shown in FIG. 9, the surface of the photosensitive belt 80 moves so as to convey the toner image. A sheet P is conveyed on the intermediate transfer belt 82, and when the sheet P passes between the secondary transfer roller 84 and the photosensitive belt 80, the toner image on the intermediate transfer belt 82 is transferred onto the sheet P.

The rotation axis line Z of the transfer roller 21 is provided to deviate from the rotation axis line V of the roller member 81 toward the downstream side of the rotation ax line W the movement direction of the upper portion of the intermediate transfer belt 82. Even in this configuration, it is possible to form a first nip portion E where only the photosensitive belt 80 and the intermediate transfer belt 82 come into contact with each other, a second nip portion F where the photosensitive belt 80 and the intermediate transfer belt 82 are nipped by the main roller body 30 and the roller member 81, and a third nip portion G which is located downstream of the second nip portion F in the movement direction of the conveyance belt and where only the intermediate transfer belt 82 and the hairs 31 come into contact with each other.

What is claimed is:

1. An image forming apparatus comprising:

a developer-image carrier, which is configured to carry a developer image on a surface thereof, and which is rotatable;

a conveyance belt, which is provided to be in contact with the developer-image carrier, and which is movable in a direction perpendicular to a rotation axis line of the developer-image carrier, wherein the conveyance belt is configured to convey the developer image carried on the developer-image carrier, and wherein the developer-image carrier is provided on a first side of the conveyance belt; and a transfer member, which is provided on a second side of the conveyance belt that is opposite to the first side, and which is configured to contact the conveyance belt to transfer the developer age carried on the developer-image carrier onto the conveyance belt, wherein the transfer member comprises:

a main roller body, which is configured to rotate in the same direction as a movement direction of the conveyance belt at a contact position with the conveyance belt, and which is provided to be parallel with the rotation axis line of the developer-image carrier; and a movable member comprising:

a first end portion fixed to a circumferential surface of the main roller body; and a second end portion, which extends outward in a radial direction of the main roller body from the first end portion, and which is movable with respect to the first end portion, and wherein a rotation axis line of the main roller body is provided downstream of the rotation axis line of the developer-image carrier in the movement direction of the conveyance belt such that the main roller body contacts the developer-image carrier while interposing the conveyance belt therebetween, wherein the conveyance belt comprises a first part, a second part and a third part, wherein at the second part the developer-image carrier and the main roller body contact the conveyance belt, wherein the first part is located upstream of the second part in the movement direction of the conveyance belt, and at the first part the developer-image carrier contacts the conveyance belt, and the main roller body and the movable member are separated from the conveyance belt, wherein the third part is located downstream of the second part in the movement direction of the conveyance belt, and at the third part the movable member contacts the conveyance belt, and the main roller body and the developer-image carrier are separated from the conveyance belt, wherein the movable member is a film member extending along the rotation axis line of the main roller body, wherein the transfer member comprises a plurality of film members, each of which is provided with an interval from an adjacent film member in a rotation direction of the main roller body, and wherein the interval is longer than a length of the film member from the first end portion to the second end portion.

2. The image forming apparatus according to claim 1, wherein the second end portion of the movable member is provided to be located downstream of the first end portion of the movable member in the rotation direction of the main roller body.

3. The image forming apparatus according to claim 1, wherein the movable member is a hair transplanted into the circumferential surface of the main roller body.

4. The image forming apparatus according to claim 1, further comprising:

a guide wall, which is positioned on the second side of the conveyance belt, and which faces the circumferential surface of the main roller body along the rotation axis line of the main roller body, wherein the guide wall is configured to guide the movable member toward a side of the main roller body.

5. The image forming apparatus according to claim 1, wherein the transfer member is configured to rotate by receiving a driving force of a motor provided to the image forming apparatus.

6. The image forming apparatus according to claim 1, wherein the movable member is made of nylon containing a conducting agent.

7. An image forming apparatus comprising:

a roller member;

a developer-image carrier belt, which is suspended on a circumferential surface of the roller member, and which is movable in a direction perpendicular to a rotation axis line of the roller member, wherein the developer-image carrier belt is configured to carry a developer image on a surface thereof;

a conveyance belt, which is provided to be in contact with the developer-image carrier belt at a position where the roller member is provided, and which is movable in a direction perpendicular to the rotation axis line of the roller member, wherein the conveyance belt is configured to convey the developer images carried on the developer-image carrier belt, wherein the developer-image carrier belt is provided on a first side of the conveyance belt; and a transfer member, which is provided on a second side of the conveyance belt that is opposite to the first side, and which is configured to contact the conveyance belt to transfer the developer image carried on the developer-image carrier belt onto the conveyance belt, wherein the transfer member comprises:

a main roller body, which is configured to rotate in the same direction as a movement direction of the conveyance belt at a contact position with the conveyance belt, and which is provided to be parallel with the rotation axis line of the roller member; and a movable member comprising:

a first end portion fixed to a circumferential surface of the main roller body; and a second end portion, which extends outward in a radial direction of the main roller body from the first end portion, and which is movable with respect to the first end portion, wherein a rotation axis line of the main roller body is provided downstream of the rotation axis line of the roller member in the movement direction of the conveyance belt such that the main roller body contacts the developer-image carrier belt while interposing the conveyance belt therebetween, wherein the conveyance belt comprises a first part, a second part and a third part, wherein at the second part the developer-image carrier and the main roller body contact the conveyance belt, wherein the first part is located upstream of the second part in the movement direction of the conveyance belt, and at the first part the developer-image carrier contacts the conveyance belt, and the main roller body and the movable member are separated from the conveyance belt, wherein the third part is located downstream of the second part in the movement direction of the conveyance belt, and at the third part the movable member contacts the conveyance belt, and the main roller body and the developer-image carrier are separated from the conveyance belt, wherein the movable member is a film member extending along the rotation axis line of the main roller body, wherein the transfer member comprises a plurality of film members, each of which is provided with an interval from an adjacent film member in a rotation direction of the main roller body, and wherein the interval is longer than a length of the film member from the first end portion to the second end portion.

8. The image forming apparatus according to claim 7, wherein the second end portion of the movable member is provided to be located downstream of the first end portion of the movable member in the rotation direction of the main roller body.

9. The image forming apparatus according to claim 7, wherein the movable member is a hair transplanted into the circumferential surface of the main roller body.

10. The image forming apparatus according to claim 7, further comprising:

a guide wall, which is positioned on the second side of the conveyance belt, and which faces the circumferential surface of the main roller body along the rotation axis line of the main roller body, wherein the guide wall is configured to guide the movable member toward a side of the main roller body.

11. The image forming apparatus according to claim 7, wherein the transfer member is configured to rotate by receiving a driving force of a motor provided to the image forming apparatus.

12. The image forming apparatus according to claim 7, wherein the movable member is made of nylon containing a conducting agent.

13. An image forming apparatus comprising:

a photosensitive member, which is configured to carry a developer image on a surface thereof, and which is rotatable; and a transfer roller, which is provided to face the photosensitive member, and which is configured to transfer the developer image onto a transferred medium;

wherein the transferred medium is configured to pass between the photosensitive member and the transfer roller in a direction perpendicular to a rotation axis line of the photosensitive member, wherein the transfer roller comprises:

a main roller body, which is configured to rotate in the same direction as a movement direction of the transferred medium at a contact position with the transferred medium, and which is provided to be parallel with the rotation axis line of the photosensitive member; and a movable member comprising:

a first end portion fixed to a circumferential surface of the main roller body; and a second end portion, which extends outward in a radial direction of the main roller body from the first end portion, and which is movable with respect to the first end portion, and wherein a rotation axis line of the main roller body is provided downstream of the rotation axis line of the photosensitive member in the movement direction of the transferred medium such that the main roller body contacts the photosensitive member while interposing the transferred medium therebetween, wherein the transferred medium comprises a first part, a second part and a third part, wherein at the second part the photosensitive member and the main roller body contact the transferred medium, wherein the first part is located upstream of the second part in the movement direction of the transferred medium, and at the first part the photosensitive member contacts the transferred medium, and the main roller body and the movable member are separated from the transferred medium, wherein the third part is located downstream of the second part in the movement direction of the transferred medium, and at the third part the movable member contacts the transferred medium, and the main roller body and the photosensitive member are separated from the transferred medium, wherein the movable member is a film member extending along the rotation axis line of the main roller body, wherein the transfer roller comprises a plurality of film members, each of which is provided with an interval from an adjacent film member in a rotation direction of the main roller body, and wherein the interval is longer than a length of the film member from the first end portion to the second end portion.

* * * * *